US009328560B2

(12) United States Patent
Püttmann

(10) Patent No.: US 9,328,560 B2
(45) Date of Patent: May 3, 2016

(54) GROUND-DRILLING DEVICE

(75) Inventor: Franz-Josef Püttmann, Lennestadt (DE)

(73) Assignee: TRACTO-TECHNIK GmbH & Co. KG, Lennestadt (DE)

( * ) Notice: Subject to any disclaimer, the term of this patent is extended or adjusted under 35 U.S.C. 154(b) by 701 days.

(21) Appl. No.: 13/640,892

(22) PCT Filed: Apr. 8, 2011

(86) PCT No.: PCT/EP2011/001764

§ 371 (c)(1),
(2), (4) Date: Oct. 12, 2012

(87) PCT Pub. No.: WO2011/128045

PCT Pub. Date: Oct. 20, 2011

(65) Prior Publication Data

US 2013/0025936 A1 Jan. 31, 2013

(30) Foreign Application Priority Data

Apr. 16, 2010 (DE) ..... 10 2010 015 465

(51) Int. Cl.

| | |
|---|---|
| ***E21B 4/14*** | (2006.01) |
| ***E21B 7/26*** | (2006.01) |
| ***E21B 17/03*** | (2006.01) |
| ***E21B 17/04*** | (2006.01) |

(52) U.S. Cl.

CPC . *E21B 4/145* (2013.01); *E21B 7/26* (2013.01); *E21B 17/03* (2013.01); *E21B 17/04* (2013.01)

(58) Field of Classification Search

CPC ..... E21B 17/03; E21B 17/04; E21B 4/145; E21B 7/26; E21B 4/14; E21B 4/06; E21B 17/0426; E21B 17/043; E21B 10/40; E21B 10/36; E21B 10/25; B25D 17/005; B25D 9/12

See application file for complete search history.

(56) References Cited

U.S. PATENT DOCUMENTS

| | | | | |
|---|---|---|---|---|
| 5,010,965 | A | 4/1991 | Schmelzer | |
| 5,794,718 | A | 8/1998 | Zollinger et al. | |
| 6,283,229 | B1 | 9/2001 | Wentworth et al. | |
| 2004/0112638 | A1* | 6/2004 | Hofmann | 175/19 |
| 2008/0245573 | A1* | 10/2008 | Puttmann | 175/57 |
| 2009/0283285 | A1 | 11/2009 | Randa | |
| 2010/0300763 | A1* | 12/2010 | Lorger | E21B 4/14 175/296 |

FOREIGN PATENT DOCUMENTS

| | | | | |
|---|---|---|---|---|
| DE | 195 08 542 | | 9/1996 | |
| EP | 0 181 712 | | 5/1986 | |
| GB | 2459578 | | 11/2009 | |
| WO | WO 2008046148 | * | 4/2008 | E21B 4/14 |

* cited by examiner

*Primary Examiner* — Brad Harcourt
*Assistant Examiner* — Carib Oquendo
(74) *Attorney, Agent, or Firm* — Howard IP Law Group

(57) ABSTRACT

A ground-drilling device includes a basic body and a drill head movably mounted in relation thereto in the longitudinally axial direction, wherein a free space, which is variable in its size owing to the movable mounting, is formed between the drill head and the basic body, and a sealing element for sealing the free space with respect to the environment, wherein the sealing element is designed as a valve element which opens when an overpressure is present inside the clearance, in order to produce a pressure compensation, and which is closed when a negative pressure is present inside the clearance, in order to prevent a pressure compensation.

12 Claims, 2 Drawing Sheets

GROUND-DRILLING DEVICE

CROSS-REFERENCES TO RELATED APPLICATIONS

This application is the U.S. National Stage of International Application No. PCT/EP2011/001764, filed Apr. 8, 2011, which designated the United States and has been published as International Publication No. WO 2011/128045 and which claims the priority of German Patent Application, Serial No. 10 2010 015 465.2, filed Apr. 16, 2010, pursuant to 35 U.S.C. 119(a)-(d).

BACKGROUND OF THE INVENTION

The invention relates to a ground-drilling device with a basic body and a drill head which is supported for movement in longitudinal axial direction relative to the basic body.

A ground-drilling device with a drill head which is supported for movement relative to a basic body is known for example from DE 195 08 542 A1. This is a self-propelled ground-drilling device, a so called ground rocket. This ground rocket has a basic body within which an impact piston is supported for movement in longitudinal axial direction. The impact piston is caused to cyclically move back and forth by the supply of compressed air, wherein in every cycle the impact piston impacts a front impact surface, whereby ultimately the kinetic energy of the impact piston is transferred to the basic body of the ground rocket to advance the latter in the soil. The front impact surface is formed by an impact bolt which is part of a drill head of the ground rocket. The drill head is supported in the basic body for movement in longitudinal axial direction; for guiding the relative movement between the drill head and the basic body the impact bolt is supported within a corresponding opening of the basic body. In addition, the impact bolt has a ring shaped shoulder at its section which extends into the basic body, with a diameter of the ring shaped shoulder being greater than the diameter of the opening into the basic body. This shoulder serves for transferring the energy which is initially transferred from the impact piston to the impact bolt or the drill head to the basic body after a defined relative movement between the drill head and the basic body. The advancement of the ground rocket in the ground occurs thus in two stages: first, the drill head is advanced by a defined distance in that the impact piston impacts the impact surface of the impact bolt; after a defined movement of the drill head relative to the basic body the ring shaped shoulder of the impact bolt impacts the impact surface of the basic body, whereby the residual energy is transferred to the basic body in order to cause the basic body to follow the drill head in the bore.

The ring shaped shoulder of the impact bolt together with the corresponding section of the basic body forms a free space whose size varies depending on the position of the drill head relative to the basic body. This free space is connected with the working chamber of the basic body via the annular gap between the ring shaped shoulder and the inner wall of the basic body, within which basic body the impact piston is cyclically moved. Although this annular gap is small it is not sealed for reasons of cost thus allowing (partial) pressure compensation between the working chamber and the free space, whereby pressurized air which was conducted into the working chamber, flows over into the free space. Because the pressure compensation between the free space and the working chamber occurs relatively slowly, an overpressure may be present in the free space after the ventilation of the working chamber, which overpressure impedes a return movement of the drill head into its retracted position. In order to avoid this, it is provided to connect the free space additionally to the environment so that an overpressure which forms in the free space can not only be released to the working chamber but also to the environment. In the ground rocket of DE 195 08 542 A1 this occurs via the also not sealed support of the impact bolt in the opening of the basic body.

The pressure compensation between the free space and the environment, is associated with the disadvantage that the entering of contaminations from outside into the free space through the non-sealed support of the impact bolt is even exacerbated; because the movement of the drill head relative to the housing into its front position first generates a negative pressure due to the speed with which this movement occurs, which negative pressure "draws" contaminations into the free space. These contaminations on one hand increase the wear of the movable components of the ground rocket and can lead to a decrease or loss of movability of the drill head.

SUMMARY OF THE INVENTION

Proceeding from this state of the art, the invention was based on the object to set forth an improved ground-drilling device with a movable drill head. In particular, the entering of undesired contaminations into the free space between the movable drill head and the basic body of the ground-drilling device is intended to be prevented with the ground-drilling device according to the invention.

This object is solved with a ground-drilling device which includes a basic body and a drill head which is supported for movement in longitudinal direction relative to the basic body, wherein between the drill head and the basic body a free space is formed whose sized is variable owing to the movable support, and a sealing element for sealing the free space against the environment, wherein the sealing element is configured as valve element, which opens when an overpressure is present in the free space to establish a pressure compensation, and which is closed when an negative pressure is present in the free space to prevent a pressure compensation. Advantageous refinements of the ground-drilling device according to the invention are the subject matter of the dependent patent claims and result from the following description of the invention.

The essence of the invention is to seal the free space which is formed between the movable drill head and the basic body with a sealing element, in which free space at times a negative pressure is present, and at times an overpressure is present, which sealing element is configured according to the invention so as to function as valve element which releases an overpressure present in the free space and when a negative pressure is present in the free space seals, in order to prevent the entering of contaminations into the free space as far as possible.

A ground-drilling device according to the invention has thus a basic body and a drill head which is supported for movement in longitudinal axial direction relative to the basic body (i.e., in the drilling direction), wherein between the drill head and the basic body a free space is formed which is variable in its size; further a sealing element for sealing the free space against the environment is provided, wherein the sealing element is configured as valve element which opens when an overpressure is present in the free space to effect a pressure compensation and which is closed when a negative pressure is present in the free space to prevent a pressure compensation.

A ground-drilling device according to the invention can be any device with which bores, and in particular horizontal bores, can be introduced into the ground. Particularly preferably, they are however self-propelled ground-drilling devices, so called ground rockets which are equipped with an internal impact mechanism (impact piston) which is propelled via supply of a pressure fluid and in particular of a pressure gas (pressurized air).

In a preferred embodiment of the ground-drilling device according to the invention, the sealing element has a sealing lip which is configured as slanted process. Such a sealing lip ensures on one hand the desired function for opening a passage only in case of an overpressure and is on the other hand easy to produce and with this cost effective.

In a further preferred embodiment of the drilling device according to the invention, the sealing element is configured or integrated into the ground-drilling device so that a defined passage between the free space and the environment is formed, wherein the passage is released or closed by the sealing lip depending on the pressure conditions. Such a defined passage between the free space and the environment enables a pressure compensation, insofar this is required for the function of the movable drill head. The additionally provided sealing lip allows sealing this defined free space in a simple manner when the entering of contaminations into the free space is to be prevented in a manner according to the invention.

Preferably, the sealing element can have a recess into which the sealing lip can descend in order to release the passage between the free space and the environment, in the case of an overpressure. This in turn allows ensuring a most unimpeded pressure compensation between the free space and the environment in the case of an overpressure in the free space.

Because the housing as well as the drill head of ground-drilling devices normally have a circular cross section, the sealing element according to the invention can be easily integrated into the housing when it is configured as sealing ring.

In a preferred embodiment of the ground-drilling device according to the invention the sealing element can exclusively or in addition, have at least one adjusted ventilation bore which connects the free space with the environment. This ventilation bore can be configured (i.e. adjusted) so small that a flow of pressurized gas can occur from the free space into the environment when an overpressure is present in the free space, at the same time however, an aspiration of contaminations is largely prevented when a negative pressure is present in the free space (this negative pressure is normally only present for a short time and with a smaller (compared to the overpressure) pressure differential). An aspiration of contaminations by the ventilation bore can also be prevented by an adjusted integration of the ventilation opening into the sealing element, in that for example the aspirated flow is deflected multiple times, before it enters the free space. These deflections can prevent that contaminations, in particular in form of relatively heavy particles or droplets actually proceed as far as into the free space.

In a particularly preferred embodiment, the at least one ventilation opening can be combined with a further sealing part (in particular a sealing lip) of the sealing element, which sealing part functions as valve element. The ventilation opening can then be arranged that the pressure gas flow which exits from the ventilation opening when an overpressure is present in the free space, flows against the region before for example the sealing lip, whereby the sealing lip which can take over the actual function of the pressure compensation is kept free of contaminations. This allows ensuring a durable function of the sealing lip.

As explained before, the ground-drilling device according to the invention is preferably constructed as self-propelled ground rocket and has thus an impact piston which is moved to oscillate within the housing and which can cyclically impact a front impact surface of the ground rocket, in order to advance the ground-drilling device in the drilling direction.

Such a ground rocket according to the invention can preferably further have a threaded ring with an outer threading, which threaded ring is screwed into a corresponding inner threading of the housing and serves for transferring the energy which is transferred by the impact piston to the housing. This threaded ring can preferably simultaneously serve as support for the movable drill head, for which purpose the ground drill device can further have an impact bolt which is connected with the drill head and extends through the threaded ring. The impact bolt can protrude over the threaded ring so that the impact piston first impacts the impact bolt and thereby moves the drill head relative to the housing.

Because such a threaded ring serves for transferring the impact energy, it has to be exchanged relatively frequently. The connection of the threaded ring with the housing in form of a threaded connection can in this case ensure a simple and fast exchangeability. A disadvantage of a threaded connection in a ground-drilling device can be however, that it is sensitive against contaminations, because a contaminated threaded connection can often no longer or only by using auxiliary means, be released again. In a preferred embodiment of the ground-drilling device according to the invention, the sealing ring can therefore be configured or integrated into the ground-drilling device so that it simultaneously seals the threaded connection between the threaded ring and the housing against the environment.

In order to facilitate the mounting and demounting of the ground-drilling device according to the invention, the threaded ring can be connected with the sealing element according to the invention, so that both elements can be inserted into the ground-drilling device as a unit or removed from the ground-drilling device again. This can occur in any desired manner. Preferably however, the sealing element insofar it is configured as sealing ring, is attached to the cylindrical projection of the threaded ring. By providing a projection of the (elastic) sealing ring and a corresponding recess in the cylindrical projection of the threaded ring, it can further be achieved that the projection of the sealing ring latchingly engages into the recess of the threaded ring and thus forms a form fitting connection between the two elements.

The sealing element of the ground-drilling device according to the invention can of course be configured multi-part.

BRIEF DESCRIPTION OF THE DRAWING

In the following, the invention is explained in more detail by way of an exemplary embodiment shown in the drawings.

In the drawings it is shown in.

DETAILED DESCRIPTION OF PREFERRED EMBODIMENTS

Figure 1:
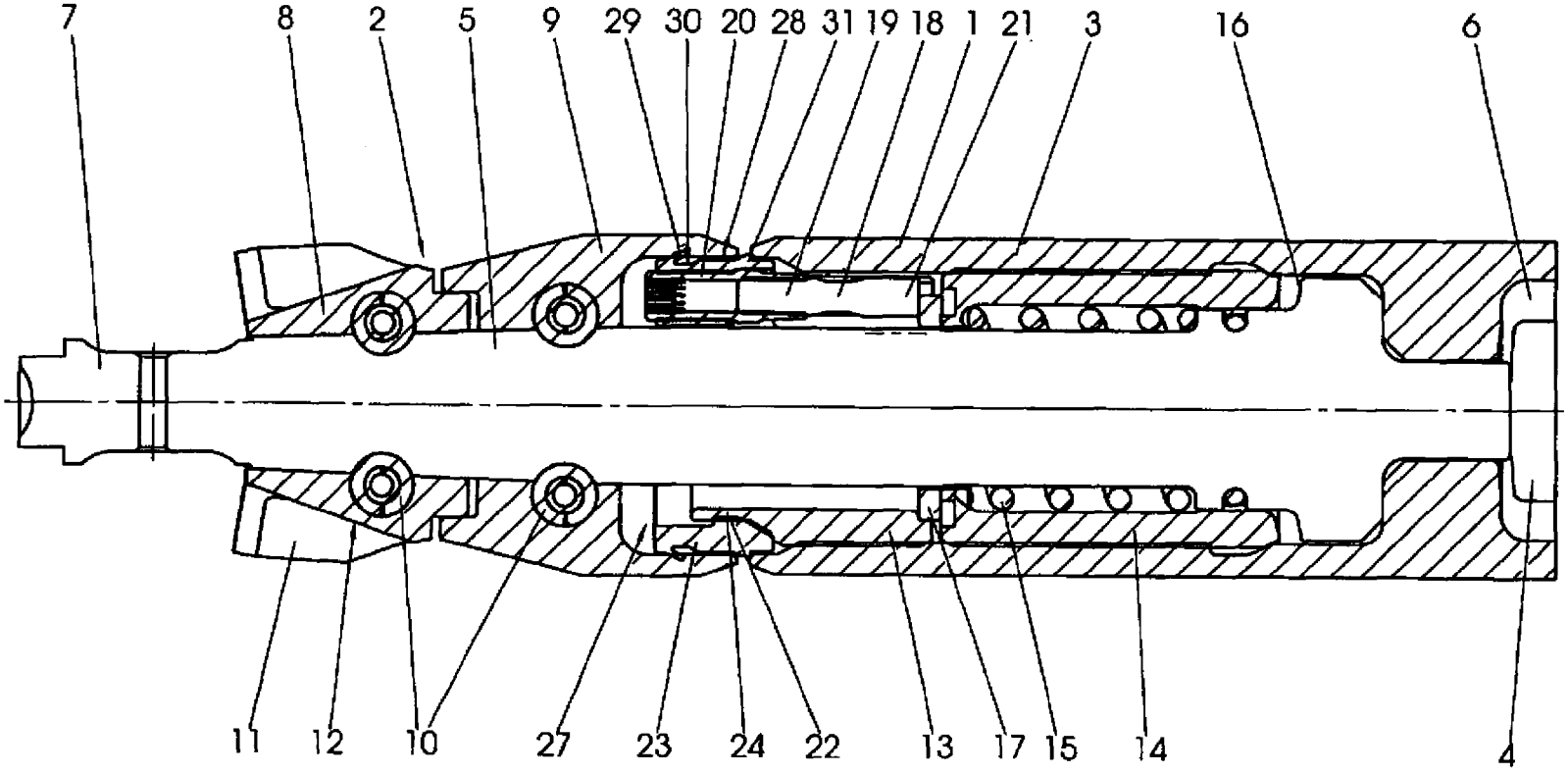
FIG. 1 a section of a ground-drilling device according to the invention in a sectional side view.

FIG. 1 shows the front section of a ground-drilling device according to the invention in a sectional side view. In this section the ground-drilling device is essentially composed of a basic body 1 and a drill head 2 which is supported for movement relative to the basic body 1. The basic body 1 includes a housing 3 in whose rear section an impact piston 4 is movably supported. The impact piston 4 is caused to move oscillatingly in a known manner by means of compressed air which is supplied to the ground-drilling device at the rear side end of the ground-drilling device via a compressed air line, wherein it impacts a front impact surface during operation of the ground-drilling device in each cycle in order to transfer the kinetic energy of the impact piston 4 in two stages first to the drill head 2 and then to the housing 1 of the ground-drilling device, to advance the ground-drilling device in the ground. The shown ground-drilling device is thus a ground rocket.

During its forward movement the impact piston 4 first impacts the rear end of the impact bolt 5 which is part of the drill head 2 and extends as far as into the working chamber 6 of the basic body 1, in which the impact piston is movably supported.

The front end of the impact bolt 5 forms a drill head tip 7 which due to its relatively small diameter ensures a high directional stability of the ground rocket during movement through the ground. Behind the drill head tip 7 two ring shaped drill head elements 8, 9 are connected behind one another to the impact bolt 5. The connection occurs by means of two respective fastening bolts 10.

The front drill head element 8 forms a plurality of cutting elements 11 which are oriented radially and whose radial extension substantially corresponds to the radius of the housing 3 and consequently to the radius of the bore to be generated. Between two neighboring cutting elements a respective channel is formed whose channel ground 12—viewed from front to back—is configured inclined. During the advancement of the drill head 2 the cutting elements 11 cut into the ground and loosen the latter which is then disposed rearward through the channels which are formed between the cutting elements 11. Due to the inclined geometry of the channel grounds 12 the ground is already displaced radially outward and compacted. This compaction is continued by the rear drill head element 9 whose sheath surface is configured conical in its front section and whose diameter widens to a diameter (viewed from front to back) which corresponds to the one of the housing 3 of the ground rocket.

In contrast to the step drill head known form the state of the art, the instant drill head which has a plurality of radially extending cutting elements 11 which already substantially correspond to the final diameter of the bore, allows achieving a particularly high directional stability of the ground rocket during its movement in the ground. Of course it is also possible to use the ground-drilling device according to the invention with any other drill head such as for example with a conventional step drill head.

The support of the impact bolt 5 in the basic body 1 is provided inter alia by the threaded ring 13 which is screwed into the front end of the housing 3. For this, the threaded ring 13 has an outer threading and the housing has a corresponding inner threading. Adjoining the rear end of the threaded ring 13 is a threaded bushing 14 which also has an outer threading which engages in a corresponding inner threaded of the housing 3. A ring shaped space is formed between the threaded bushing 14 and the corresponding section of the impact bolt 5, in which space a cylindrical 15 is arranged. This helical spring 15 is supported on its front side on a projection of the threaded bushing 14 and on its rear side on a projection of the impact bolt 5.

As soon as the impact piston 4 impacts the rear end of the impact bolt 5 the latter and the further elements of the drill head 2 connected thereto are displaced forward relative to the basic body 1 of the ground rocket. The cylindrical helical spring 15 is compressed by the movement of the impact bolt 5 relative to threaded bushing 14, whereby a pre-tensioning is generated which later supports the return movement of the drill head 2 into its retracted basic position.

After a defined forward movement of the impact bolt 5 relative to the basic body 1, a ring shaped shoulder 16 of the impact bolt 5 impacts the rear end of the threaded bushing 14. In this way the kinetic energy remaining in the impact bolt 5 is also transferred to the basic body 1 of the ground rocket, so that the basic body 1 is then advanced in the ground together with the drill head 2. The rear end of the threaded bushing 14 thus forms a front impact surface of the basic body 1 of the ground rocket.

After the energy which was transferred to the impact bolt 5 by a strike of the impact piston, is completely converted, the advancement of the ground rocket in the ground comes to a halt. Due to the pre-tensioning of the helical spring 15, the still forwardly displaced drill head is retracted again into its starting position. At the same time the impact piston 4 is guided in a further cyclical movement, wherein the interplay is repeated when the impact piston impacts the rear end of the impact bolt again.

The forces which are transferred from the shoulder 16 of the impact bolt 5 to the threaded ring 13 are transferred to the housing 3 via the bolted connection with the housing. Because this represents a significant stress the threaded bushing 14 has to be secured to prevent that it is displaced from the desired position by the strikes. This securing of the threaded bushing 14 is achieved by the threaded ring 13 which is supported on the front end of the threaded bushing 14 via a spacer ring 17.

Figure 2:
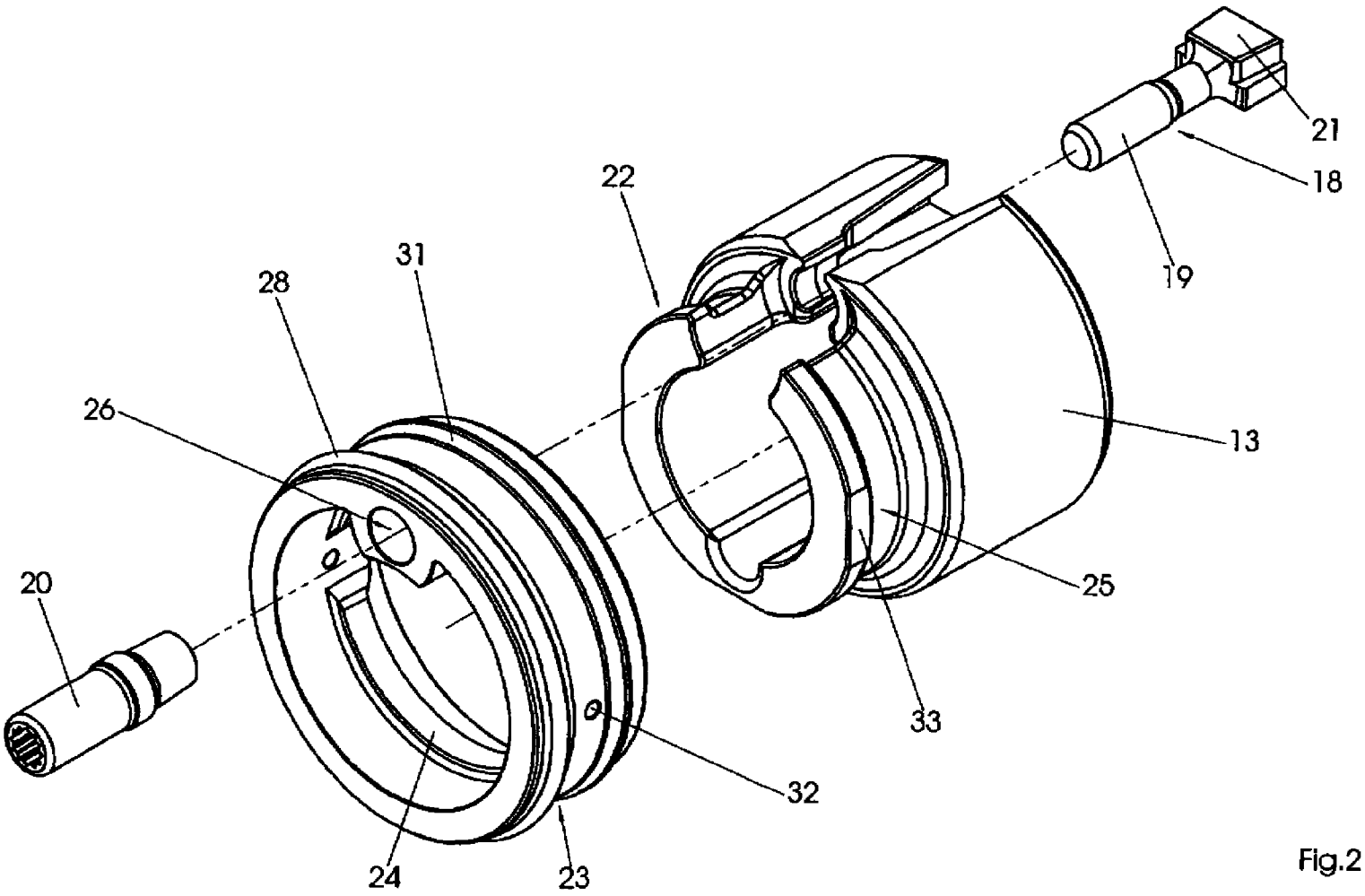
FIG. 2 in a perspective view individual elements of the ground-drilling device of FIG. 1.

As shown in FIG. 2, the threaded ring 13 is slotted on one side in longitudinal axial direction, wherein the slot is configured conical on the end which faces the threaded bushing 14. An expansion element 18 is inserted into the slot, which expansion element 18 has a threaded bolt 19 which can be screwed together with a threaded sleeve 20. By screwing in of the threaded bolt 19 into the threaded sleeve 20, a conical head part 21 of the expansion element is drawn into the corresponding conical section of the slot whereby the threaded ring 13 is spread out. In this way the area surface pressure of the bolted connection between the threaded ring 13 and the housing 3 is increased and thereby a secured fit of the threaded ring 13 and with this also of the threaded bushing 14 in the housing 3 is achieved.

On its front end the threaded ring 13 is provided with a cylindrical projection 22, which serves for receiving a sealing ring 23 according to the invention. The sealing ring 23 is made of an elastic material (for example elastomer) and forms a projection 24 on its inner surface, which projection 24 can engage in a corresponding recess 25 of the cylindrical projection 22 of the threaded ring 13.

This allows achieving a secure connection of the threaded ring 13 with the sealing ring 23, so that the two components can be handled as a unit and in particular mounted into the ground rocket or demounted from the ground rocket. The sealing ring 23 further forms a through bore 26 which serves for receiving the threaded bushing 20.

The movable support of the impact bolt 5 in the basic body 1 results in a connection between the working chamber 6 in which the impact piston 4 is movably guided and the free space 27 which is formed between the rear drill head element 9 and the impact bolt 5 (as parts of the drill head 2) and the sealing ring 23, the threaded ring 13 and the spacer ring 17 (as parts of the basic body 1). To keep the ground rocket constructively as simple as possible, no sealing is provided which would securely prevent that the at times high overpressure (relative to the environment of the ground rocket) present in the working chamber 6 causes the pressurized air contained therein to overflow into the free space 27. Consequently, an overpressure (relative to the environment of the ground rocket) is temporarily also generated in the free space 27, which has to be compensated again relatively quickly because this overpressure would otherwise impede the return movement of the drill head 2 which is supported by the helical spring 15. This pressure compensation is achieved in that between the rear drill head element 9 and the sealing ring 13 an annular gap 28 is formed via which the pressure compensation between the free space 27 and the environment can occur.

This annular gap 28 has the disadvantage however, that the contaminations (in particular soil and water) can enter into the free space 27 from the environment, whereby at least the wear of the movable parts is increased and the mobility of these parts can be impeded. The risk of an entering of contaminations is particularly given because the free space is temporarily quickly increased by the forward movement of the drill head, whereby (temporarily) a negative pressure (relative to the environment) is generated. This negative pressure can cause contaminations to be aspirated through the annular gap.

To prevent this, the sealing ring 23 is provided with a sealing lip 29 which is configured so as to point slantedly rearward. Due to the particular configuration of the sealing lip 29 the latter can be deformed in case of an overpressure in the free space 27, whereby it can descent into a ring shaped recess 30 of the sealing ring 23 which recess is located adjacent to the sealing lip 29. This releases the annular gap 28. When, on the other hand a negative pressure relative to the environment is present in the free space 27 this negative pressure leads to the sealing lip 29 being pressed against the inner surface which is formed by the rear drill head element 9 and the annular gap 28 being closed.

The sealing ring 23 further has two small opposing ventilation openings 32 which in conjunction with two flat portions 33 in a front shoulder of the cylindrical projection 22 form a connection between the free space 27 and the environment. Through these ventilation openings 32 a flow of pressurized gas can occur from the free space into the environment when an overpressure is present in the free space. At the same time however, an aspiration of contaminations is largely prevented when a negative pressure is present in the free space 27 because the ventilation openings 32 on one hand only have a relatively small diameter and on the other hand are arranged in the sealing ring 23 or integrated into the ground-drilling device so that an air flow from the environment into the free space 27 is deflected multiple times (compare FIG. 1) before the air flow enters the free space 27. This deflection prevents that contaminations enter as far as into the free space due to their inertia.

In the mounted state of the sealing ring 23, the ventilation openings 32 lead into the gap which is formed between the sealing ring 23 and the rear drill head element 9 and with this—viewed from the environment—before the sealing lip 29. The compressed air which temporarily exits the ventilation openings 32 can prevent that contaminations accumulate at the side of the sealing lip 29 which faces the gap, which may impede the function of the sealing lip 29 after a longer use of the ground-drilling device.

The sealing ring 23 additionally has a ring shaped sealing bulge 31 which partially rests against the front end of the housing 3. This sealing bulge 31 prevents that contaminations enter the threaded connection between the threaded ring 13 and the housing 3. This allows ensuring that the threaded connection can be released without great effort also after a longer use of the ground rocket.

The invention claimed is:

1. A ground-drilling device comprising:

a basic body;

a drill head which is supported for movement in a longitudinal axial direction relative to the basic body, wherein a free space is formed between the drill head and the basic body, and wherein a size of the free space is variable as a function of said movement;

an impact piston which is moved so as to oscillate within the basic body; and a sealing element for sealing the free space against an environment and comprising at least one adjusted ventilation opening for connecting the free space with the environment, wherein the sealing element is configured as a valve element, wherein said valve element opens when an overpressure is present in the free space to thereby establish a pressure compensation, and which is closed when a negative pressure is present in the free space to thereby prevent the pressure compensation, and wherein the sealing element operates independent of the position of the drill head and the impact piston.

2. The ground-drilling device of claim 1, wherein the sealing element includes a sealing lip which is configured as a slanted projection.

3. The ground-drilling device of claim 2, wherein the sealing element is configured to form a defined passage between the free space and the environment, wherein the passage is released or closed by the sealing lip in dependence on the pressure conditions.

4. The ground-drilling device of claim 3, wherein the sealing element has a recess for receiving the sealing lip, to thereby release the passage between the free space and the environment in case of an overpressure.

5. The ground-drilling device according to claim 1, wherein the sealing element is configured as a sealing ring.

6. The ground-drilling device of claim 1, wherein the impact piston cyclically impacts a front impact surface of the ground-drilling device to advance the ground-drilling device.

7. A ground-drilling device comprising:

a basic body;

a drill head which is supported for movement in a longitudinal axial direction relative to the basic body, wherein a free space is formed between the drill head and the basic body, and wherein a size of the free space is variable as a function of said movement;

an impact piston which is moved so as to oscillate within the basic body and cyclically impacts a front impact surface of the ground-drilling device to advance the ground-drilling device;

a sealing element for sealing the free space against an environment and comprising at least one adjusted ventilation opening for connecting the free space with the environment, wherein the sealing element is configured as a valve element, wherein said valve element opens when an overpressure is present in the free space to thereby establish a pressure compensation, and which is closed when a negative pressure is present in the free space to thereby prevent the pressure compensation; and an impact bolt, wherein the basic body comprises a housing provided with an internal threading and a threaded ring provided with an outer threading, wherein the threaded ring is at least partially screwed into the housing wherein the impact bolt is connected with the drill head and extends through the threaded ring and protrudes over the threaded ring, thereby enabling the impact piston to impact the impact bolt and thereby moving the drill head relative to the housing.

8. The ground-drilling device of claim 7, wherein the sealing element is connected with the threaded ring.

9. The ground-drilling device of claim 8, wherein the sealing element is configured as sealing ring and is attached to a cylindrical projection of the threaded ring.

10. The ground-drilling device of claim 8, wherein the sealing ring is connected with the threaded ring in a tensile and/or pressure resistant manner.

11. A ground-drilling device comprising:

a basic body;

an impact piston which is moved so as to oscillate within the basic body and cyclically impacts a front impact surface of the ground-drilling device to advance the ground-drilling device;

a drill head which is supported for movement in a longitudinal axial direction relative to the basic body, wherein a free space is formed between the drill head and the basic body, and wherein a size of the free space is variable as a function of said movement;

an impact bolt, wherein the basic body comprises a housing provided with an internal threading and a threaded ring provided with an outer threading, wherein the threaded ring is at least partially screwed into the housing wherein the impact bolt is connected with the drill head and extends through the threaded ring and protrudes over the threaded ring, thereby enabling the impact piston to impact the impact bolt and thereby moving the drill head relative to the housing; and a sealing ring for sealing the free space against an environment, wherein the sealing ring is configured as a valve element, wherein said valve element opens when an overpressure is present in the free space to thereby establish a pressure compensation, and which is closed when a negative pressure is present in the free space to thereby prevent the pressure compensation, wherein the sealing ring seals the threaded connection between the threaded ring and the housing against the environment.

12. The ground-drilling device of claim 11, wherein the sealing ring comprises at least one adjusted ventilation opening for connecting the free space with the environment.

* * * * *